US005311681A

United States Patent [19]

Ruvang et al.

[11] Patent Number: 5,311,681

[45] Date of Patent: May 17, 1994

[54] RETAINING MECHANISM

[75] Inventors: John A. Ruvang, Carrollton; Howard W. Robinson, Grapevine, both of Tex.; Darrell L. Carver, Scottsdale, Ariz.

[73] Assignee: GH Hensley Industries, Inc., Dallas, Tex.

[21] Appl. No.: 865,122

[22] Filed: Apr. 8, 1992

[51] Int. Cl.[5] ..... E02F 9/28

[52] U.S. Cl. ..... 37/457; 37/452

[58] Field of Search ..... 37/141 R, 141 T, 142 R, 37/142 A

[56] References Cited

U.S. PATENT DOCUMENTS

| | | | |
|---|---|---|---|
| 3,526,049 | 9/1970 | Nichols | 37/142 A |
| 3,572,785 | 3/1971 | Larson | 37/142 A |
| 3,722,932 | 3/1973 | Dougall | 37/142 A X |
| 4,267,653 | 5/1981 | Hahn et al. | 37/142 |
| 4,413,432 | 11/1983 | Bierwith | 37/142 A |
| 4,579,494 | 4/1986 | Bierwith | 37/142 A X |
| 4,663,867 | 5/1987 | Hahn et al. | 37/142 |

*Primary Examiner*—Dennis L. Taylor
*Assistant Examiner*—Arlen L. Olsen

[57] ABSTRACT

A retaining mechanism (10) for captively retaining an adapter (4) to the forward lip (2) of a bucket for earth excavating utilizes a ratcheted pawl (14) within a C-clamp (12). The pawl ratchet (24) engages a complementary pawl surface (26) of the rear half (16*b*) of a split pin assembly (16). The forward half (16*a*) of the split pin can be attached to the rear half (16*b*) by shear screws (52). Moreover, the forward half (16*a*) of the split pin can be attached to the rear half (16*b*) by an elastomeric element (64). The split pin assembly (16) acts as a wedge member, firmly securing the adapter (4) to the lip (2). To remove the retaining mechanism (10) from the adapter (4) and lip (2), the pawl (14) may be disengaged from the rear split pin (16*b*) by manipulating the pawl through an access port (28) in the C-clamp (12). Alternatively, the forward split pin (16) may be driven through the opening in the adapter and lip.

20 Claims, 3 Drawing Sheets

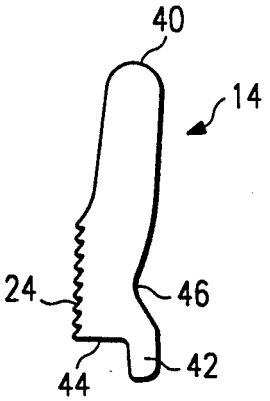
FIG. 2A
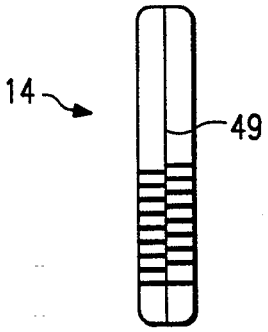
FIG. 2B
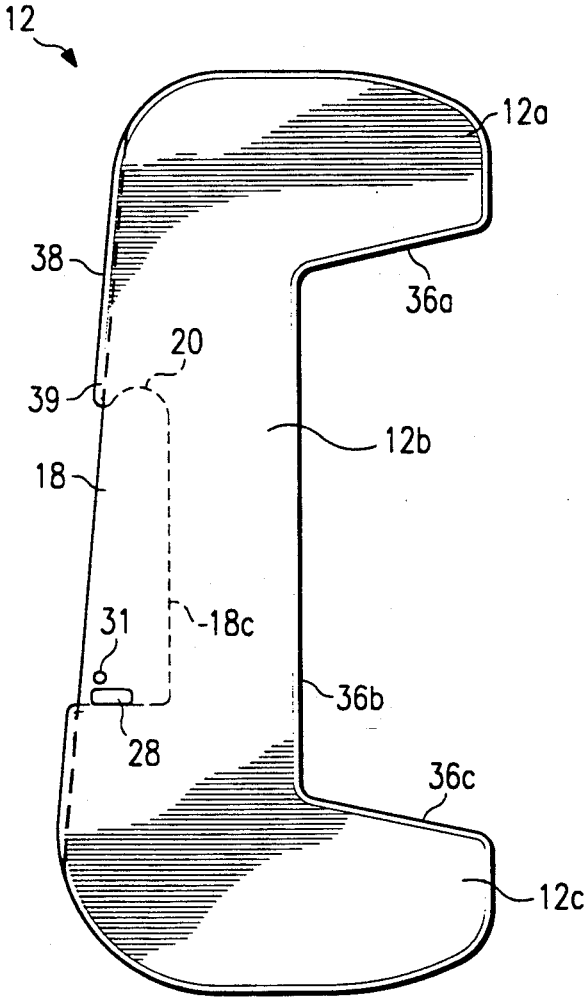
FIG. 3A
FIG. 3B
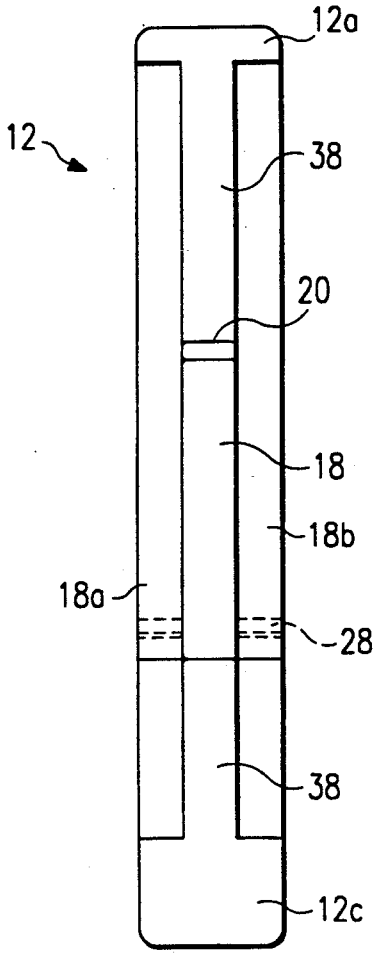

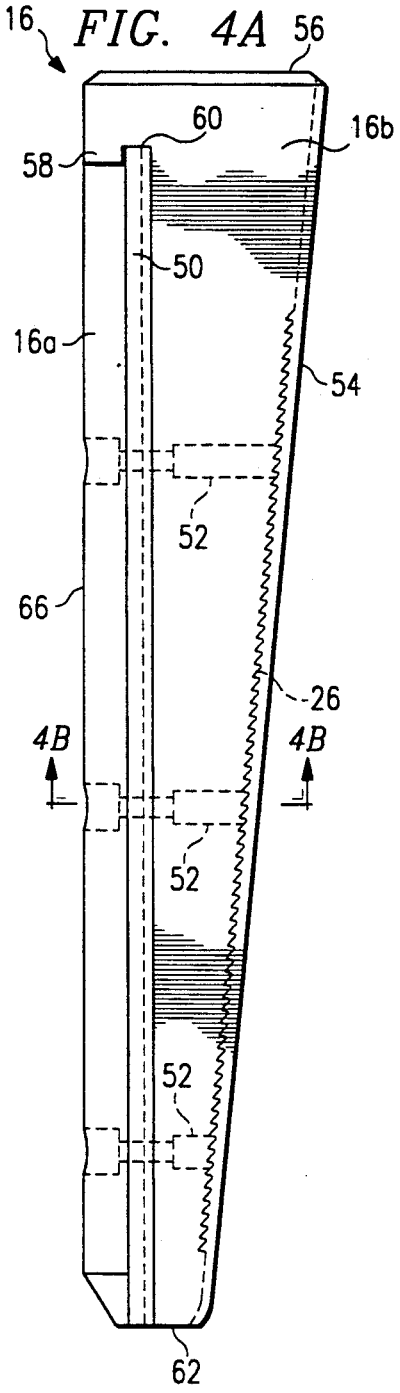
FIG. 4A
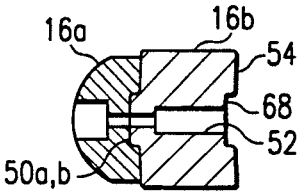
FIG. 4B
FIG. 5C
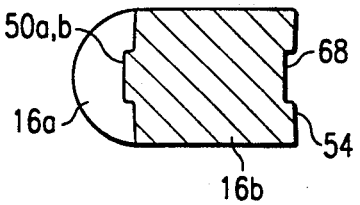
FIG. 5A
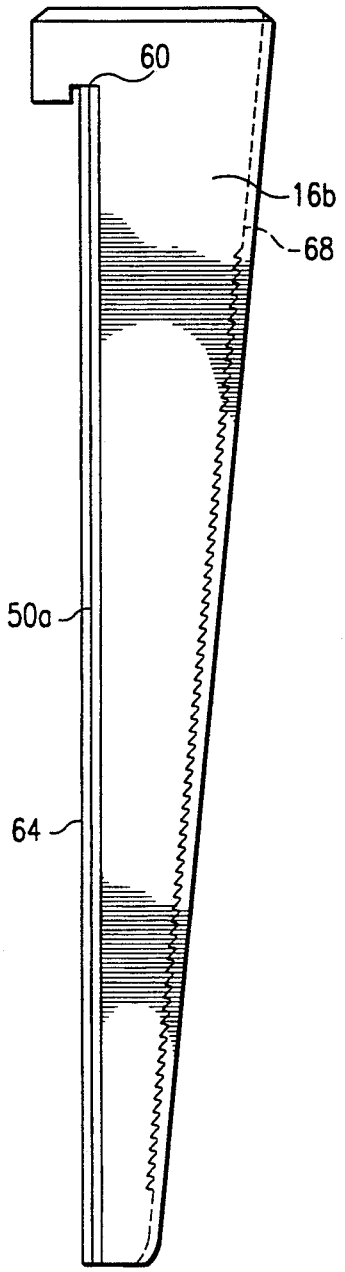
FIG. 5B
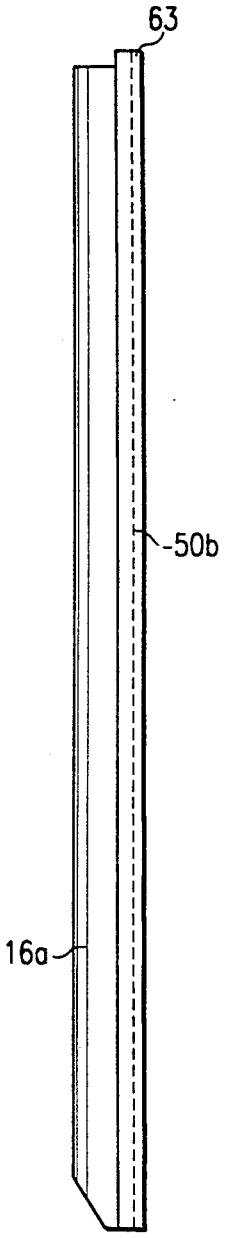

RETAINING MECHANISM

TECHNICAL FIELD OF THE INVENTION

The present invention relates generally to earth excavating equipment, and more particularly to an improved retaining mechanism using a ratcheted pawl to captively retain a replaceable adapter element secured to the forward lip of an excavating bucket or the like.

BACKGROUND OF THE INVENTION

Excavating equipment typically utilizes a bucket with a forward lip to scoop up quantities of earth for transport. A number of adapters can be removably attached to the forward lip of said bucket, while a plurality of teeth are removably attached to the adapters. To captively retain the adapter to the forward bucket lip, aligned transverse openings are formed through these interengageable elements, and a retaining mechanism is driven into these elements.

Retaining elements or locking devices for attaching the adapter to the bucket have a variety of configurations. For example, U.S. Pat. No. 4,267,653 to Hahn et al. discloses a "Locking Device for Excavating Equipment" which utilizes a clamp member, locking member, and wedge for releasably locking a slip-over adapter to the lip of a shovel dipper. The locking member is mounted in a recess in the confronting face of the clamp member. The clamp member is then installed within the aligned openings of the lip and adapter and seated against the lip. The wedge member is vertically elongated and is tapered by having a forward wall downwardly convergent relative to a rearwardly facing wall. The confronting wall is equipped with a series of crests and valleys. The locking member also includes an elongated body which in the forwardly facing portion thereof is constructed to define a plurality of cooperating crests and valleys. Bonded to the locking member is a resilient portion. As the wedge member is driven into the aligned openings adjacent to the clamp member, the crests and valleys of both the wedge member and the locking member engage. The resilient portion of the locking member is equipped with a longitudinally extending bore which enables the locking member to compress back into the cavity or recess whenever the wedge moves one-half a notch. Thereafter, the lock member moves back to its original position when the movement equals one full notch.

Likewise, U.S. Pat. No. 4,663,867 to Hahn et al. also discloses a "Locking Device for a Whisler Type Adapter" which utilizes a wedge, C-clamp lock, and a spring loaded keeper member interposed therebetween. There is no taper between the mating faces of the wedge and C-clamp. In operation, the locking device is able to move freely as the adapter moves so there is no constraint behind the C-clamp and wedge assembly. The wedge member is equipped with a ratchet adapted to engage and mate with a ratchet portion provided on the keeper member. The keeper member is also provided with a plurality of rearwardly extending ports on which the springs are mounted. The springs are also supported in countersunk openings provided in the forward face of the C-clamp. A lug is also provided on the rearward surface of the keeper member, said lug being apertured to receive a pin. The pin is slidably mounted within a horizontally extending slot provided in the side wall of the C-clamp. In sum, the system flexes with the movement of the Whisler adapter about the lip, allowing the adapter to move rather than utilize a solidly locked C-clamp and wedge system which is intended to keep the adapter tight on the lip.

A disadvantage with both Hahn et al. ('653) and Hahn et al. ('867) lies with their flexibility. With Hahn et al. ('653), to allow for the insertion of the wedge, the elastomeric element must provide a certain amount of compressibility. However, this same compressibility allows for too much vibration during operation. This vibration can lead to the ejection of the wedge. Likewise, the spring assembly in Hahn et al. ('867) tends to fail due to the amount of flex to which the system is subjected.

Therefore, a need exists for a retaining mechanism that firmly engages an adapter to the forward lip of an excavating bucket. Such a retaining mechanism should allow for easy removal of any wedge member used. Moreover, such a retaining mechanism should display only the slightest elasticity.

SUMMARY OF THE INVENTION

The present retaining device allows the captive retention of an adapter, such as a Whisler Type adapter, to the forward lip of a bucket for earth excavation. Both the adapter and the forward lip of the bucket have transverse openings therethrough. These openings align upon the engagement of the adapter over the forward lip. The retaining device comprises a C-clamp, a ratcheted pawl, and a ratcheted split pin. Upon alignment of the openings, a first surface of the C-clamp can be positioned so that its concave surface seats against a forward facing rear adapter wall. The second, convex, face of the C-clamp is provided with a pawl cavity. The pawl cavity has a pair of opposed side walls which captively retain the pawl therebetween. The pawl cavity further comprises a curved upper surface which complements the curved upper surface of the pawl. The pawl is provided with a ratchet face.

After insertion of the pawl into the pawl cavity, a split pin assembly is inserted adjacent to the C-clamp and pawl assembly in the opening. The split pin assembly wedge fits into the opening. The split pin is provided with a forward half and a rear half. The rear half has a ratchet face which is adjacent to and complements the pawl ratchet face. The split pin halves can be connected by a shearable connection means. In one embodiment, the forward and rear halves of the split pin are connected by shear screws. In an alternate embodiment, the forward and rear halves of the split pin are attached by an elastomeric element.

The pawl is biased against the split pin by biasing means such as an elastomeric rubber spring positioned between the pawl and the C-clamp. The pawl can be held against the curved upper surface of the pawl cavity by a pawl pin. The pawl pin may be inserted through a perpendicular aperture in the opposed side walls of the pawl cavity. Despite the constraint provided by the pawl pin, the pawl is positioned within said pawl cavity such that it can rotate between an engaged and a disengaged position. In the engaged position, the pawl ratchet surface engages the rear split pin ratchet surface. To disengage the ratcheted surfaces, a tool may be inserted through an access port in at least one of the pawl cavity side walls. The access port is located so that the tool can engage a pawl lip so as to rotate the pawl away from the split pin. Once disengaged, the split pin assembly may be driven upward through the transverse openings in the adapter and lip assembly.

The top portion of the rear split pin can extend over the top portion of the front split pin, thus presenting a single impact surface for insertion of the split pin assembly. After insertion of the split pin, the top portion of both the front and rear split pins can be removed at a level approximately flush with the top surface of the C-clamp. Upon removal, a top surface portion of both the rear and forward split pin is exposed. Therefore, to remove the retaining mechanism, the forward half of the split pin can be driven downward through the transverse opening in the adapter and lip assembly, thereby shearing the shearable connection means.

Thus, the present retaining mechanism firmly engages an adapter to the forward lip of an excavating bucket. Further, the retaining mechanism allow for easy removal of the split pin wedge member. Moreover, the retaining mechanism displays virtually no elasticity.

BRIEF DESCRIPTION OF THE DRAWINGS

For a more complete understanding of the present invention, and for further details and advantages thereof, reference is now made to the following Detailed Description taken in conjunction with the accompanying drawings, in which:

FIGS. 2A and 2B provide two side views of the pawl;

FIGS. 3A and 3B provide two side views of the C-clamp;

FIGS. 4A and 4B illustrate a split pin wherein the forward and rear pin halves are connected by shear screws; and FIGS. 5A, 5B, and 5C provide two side views and a sectional view of a split pin separated by an elastomeric element.

DETAILED DESCRIPTION OF THE DRAWINGS

Figure 1:
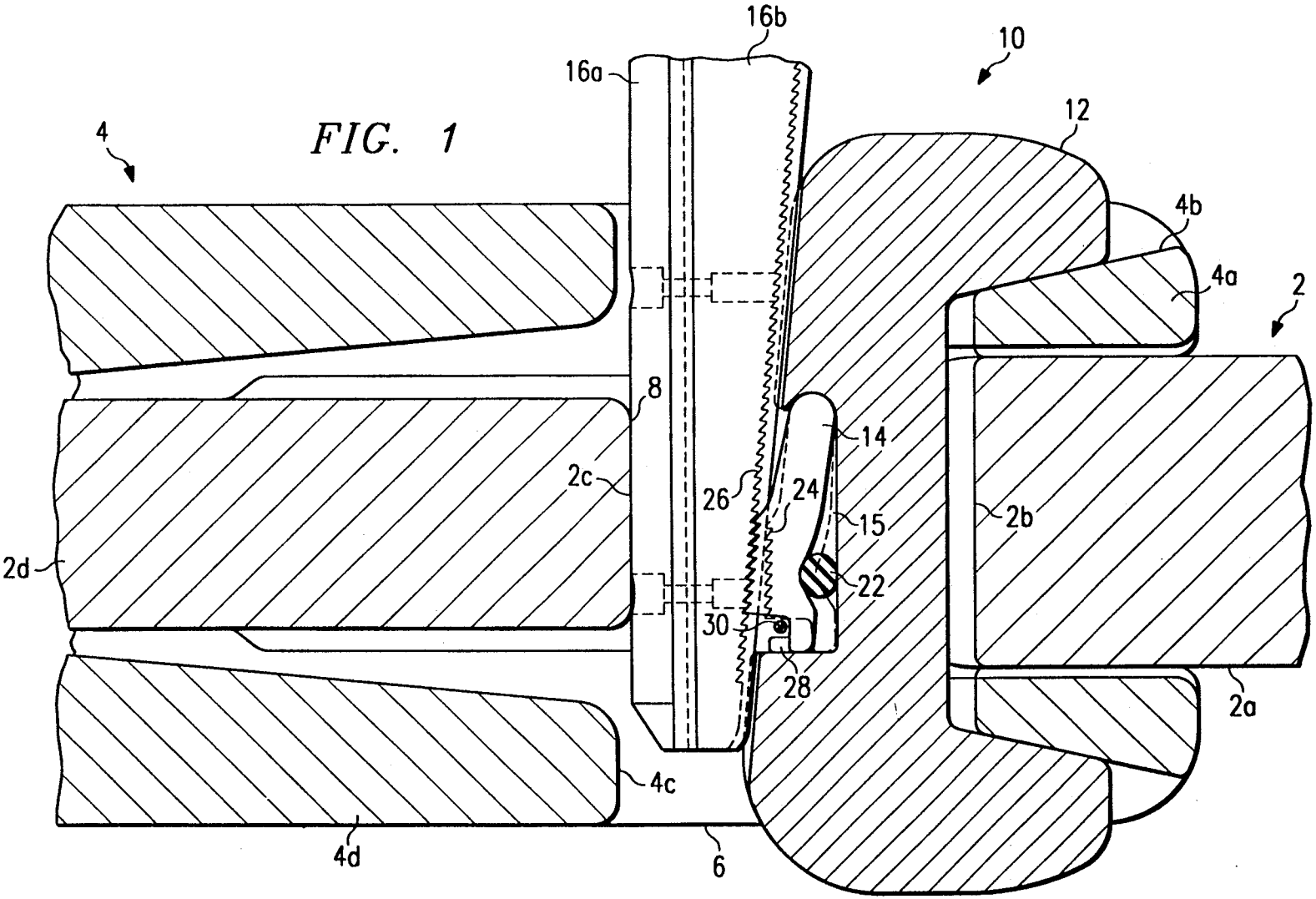
FIG. 1 provides a side sectional view of the retaining mechanism upon insertion.

The present retaining mechanism overcomes many of the disadvantages of the prior art by utilizing a ratcheted pawl to captively retain a replaceable adapter element to the forward lip of an excavating bucket or the like. Referring to FIG. 1, a retaining mechanism 10 embodying the present invention is shown engaged between a lip 2 and an adapter 4. The lip 2 has a proximal portion 2*a* and a distal portion 2*d*. A transverse opening 8 in the lip 2 is defined by lip walls 2*b* and 2*c*. Likewise, the adapter 4 comprises a proximal portion 4*a* and a distal portion 4*d*. A transverse opening 6 in the adapter 4 is defined by adapter walls 4*b* and 4*c*. The illustrated adapter 4 is also known as a Whisler Type adapter. The transverse openings 6, 8 align upon the engagement of the adapter 4 and the lip 2.

The retaining mechanism 10 comprises a C-clamp 12, a pawl 14, and a split pin 16 with a forward half 16*a* and a rear half 16*b*. The C-clamp 12 comprises a first surface 36*a–c* which is generally concave in shape and a second surface 38 which is generally convex. The second surface 38 further comprises a pawl cavity 18 which captively retains the pawl 14 between cavity side walls. The first surface 36 of the C-clamp 12 engages the forward surface 4*b* of the proximal portion 4*a* of the adapter 4. The pawl cavity 18 has a curved upper surface 20 and is accessible through an access port 28.

The pawl 14 can be a generally elongate member with a curved upper surface 40, a ratcheted surface 24 and a lip portion 42. A biasing means 22 can be placed in the pawl cavity 18 between the pawl 14 and the rearward pawl cavity surf ace. The pawl 14 is constrained by a pawl pin 30 which is slidably inserted into an aperture through the pawl cavity side walls.

The split pin 16 is generally tapered to provide a wedge fit between the rearward face 2*c* of the distal lip portion 2*d* and the forward half 16*a* of the C-clamp 16. The rearward face of the rear split pin 16*b* is provided with a ratcheted surface 26. Biasing means 22 tend to bias the pawl 14 against the rear split pin 16*b*. The ratchet surface 24 of pawl 14 can engage the ratcheted surface 26 of the rear split pin 16*b*. Due to the configuration of the ratchet teeth, the split pin 16 can be advanced downward relative to the pawl 14, but cannot be retrieved upward while the ratchet surfaces 24, 26 are engaged. To disengage the ratchet surfaces 24, 26, a tool can be inserted through the access port 28, and the pawl 14 urged to a disengaged position as shown by phantom line 15.

Referring to FIGS. 2A and 2B simultaneously, the pawl 14 is shown in greater detail. As stated, the pawl 14 is generally elongate member with a curved upper surface 40. A rear face is provided with a biasing means indentation 46 for receiving a biasing means. A pawl lip 42 extends downward from the pawl 14 and provides a surface for manipulating the pawl 14 from the access port 28 (shown in FIG. 1). A pin surface 44 is adjacent to the ratcheted surface 24, and allows for sliding engagement over the pin 30. The pawl 14 can be between five to six inches long, and approximately one to two inches wide. The distance between the peak of each ratchet tooth can be one quarter inch. Also, the pawl 14 can be approximately one inch in thickness. These dimensions, of course, can vary according to the situation. FIG. 2B illustrates an alternate embodiment wherein the pawl 14 is longitudinally split along line 49, thus creating two sets of ratchet teeth. The ratchet teeth on each half can then be offset allowing more precise placement of the split pin.

Referring to FIGS. 3A and 3B, simultaneously, the C-clamp 12 comprises a central portion 12*b* and two generally perpendicular portions 12*a*, 12*c* on either end of the central portion 12*b*. The first surface 36, likewise, has three portions 36*a*, 36*b*, and 36*c*. First surface portions 36*a*, 36*b* are dimensioned to engage the forward adapter face 4*b*. The pawl cavity 18 is formed in the second face 38 of the C-clamp 12 and bounded by pawl cavity side walls 18*a*, 18*b* and pawl cavity rear wall 18*c*. At least on pawl cavity side wall 18*a*, 18*b* can be penetrated by the access port 28 and the pin aperture 31. The access port 28 is located adjacent to the location of the pawl lip 42 of an installed pawl 14. The pawl cavity 14 has an upper surf ace 20 curved to complement the upper surface 40 of the pawl 14. The second face 38 also has a raised guide ridge 39.

FIGS. 4A and 4B illustrate one embodiment of the split pin assembly 16 for use with the retaining mechanism 10. The split pin comprises a forward half 16*a* and a rear half 16*b*. The halves 16*a* and 16*b* of the split pin are connected by at least one shear screw, or other shearable connection means, located in shear screw holes 52. Rear split pin 16*b* engages the forward split pin 16*a* in tongue and groove fashion as designated by line 50*a,b*. The forward split pin half 16*a* can have a groove 50*b*, while the rear split pin half 16*b* can have a tongue 50*a*. The forward split pin half 16*a* further has a tab 63 to lock into groove 60 in the rear split pin half 16*b*. These arrangements insure alignment of the forward and rear split pin halves. The rear surf ace 54 of the split pin assembly is convergently tapered from top portion 56 toward tapered end 62, while the forward face 66 is generally vertical.

The rear split pin 16*b* can have a top portion 56 which overlaps the forward split pin half 16*a*. This provides a single impact surface to aid in the insertion of the split pin assembly 16. Thus, the split pin assembly 16 is inserted into the aligned transverse openings by placing tapered end 62 into the opening first, and then striking top portion 56 with sufficient force to wedge fit the split pin into the opening. After insertion, a top portion of the split pin assembly 16 is removed at a level approximately flush with the top surface of the C-clamp. After removal of this top portion, a top surface of both split pin halves is exposed. Therefore, to remove the retaining mechanism 10 or to replace the split pin assembly 16, a force can be applied to the exposed top surface of the forward split pin half 16*a*. This force must be adequate to shear the shearable connection means.

FIGS. 5A and 5B illustrate an alternate embodiment of the split pin 16 wherein said split pin halves can be attached by an elastomeric element 64. The forward and rear split pin halves 16*a*, 16*b* are similar to those disclosed in the above discussion, except for the lack of shear pin holes 52. Also, an elastomeric element 64 can be attached to the face of either or both split pin halves. The elastomeric element 64 is shown bonded to the face of the rear split pin half 16*b*. The split pin assembly 16 can be removed in similar fashion to that described above. In other words, a force is applied to the exposed top surface of the forward split pin half 16*a*. This force can shear either the elastomeric element 64 or the bonding material used to affix the elastomeric element to the split pin. FIG. 5C provides a sectional view across the split pin assembly 16. A C-clamp engagement groove 68 can be provided on the rear surface 54 of the rear split pin half 16*b*. This groove 68 complements the guide ridge 39 on the C-clamp (shown in FIG. 3A).

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. Accordingly, the present invention is intended to encompass such rearrangements, modifications, and substitutions of parts and elements as fall within the scope of the invention.

We claim:

1. A retaining mechanism for captively retaining an adapter interengaged to the forward lip of an excavating bucket, said adapter and lip having aligned transverse openings therethrough, said retaining mechanism comprising:

(a) a C-clamp with a first and second face, said first face engaged to a forward wall of the adapter, said second face having a pawl cavity, said pawl cavity defined by opposing pawl cavity side walls and a rear pawl cavity wall, at least one of said pawl cavity side walls having an access port therein;

(b) a pawl cavity retained within the pawl cavity of the C-clamp, said pawl having a plurality of pawl ratchet teeth thereon;

(c) a split pin having a rear half and a forward half, a face of the rear half having a plurality of ratchet teeth thereon, said split pin providing a wedge fit between the C-clamp and the lip; and (d) a biasing means between said C-clamp and said pawl, said biasing means positioned to bias the pawl against the split pin.

2. The retaining mechanism of claim 1 wherein said pawl is positionable within said pawl cavity between an engaged and a disengaged position.

3. The retaining mechanism of claim 1 wherein said biasing means comprises a resilient rubber spring.

4. The retaining mechanism of claim 1 wherein said front split pin half and said rear split pin half are attached by shear screws.

5. The retaining mechanism of claim 1 wherein said front split pin half and said rear split pin half are separated by an elastomeric element.

6. The retaining mechanism of claim 1 wherein said pawl is split into a first pawl section and a second pawl section, each of said pawl sections having a ratchet surface, said ratchet surface of one pawl section offset from that of the other pawl section.

7. The retaining mechanism of claim 1 wherein the pawl cavity side walls are penetrated by a pin aperture.

8. The retaining mechanism of claim 7 further comprises a pawl pin slidably engaged in the pin aperture.

9. The retaining mechanism for captively retaining an adapter interengaged to the forward lip of an excavating bucket, said adapter and lip having aligned transverse openings therethrough, said retaining mechanism comprising:

(a) a C-clamp with a first and second face, said first face engaged to a forward wall of the adapter, said second face having a pawl cavity, said pawl cavity comprises (i) opposing pawl cavity walls and (ii) a rear pawl cavity wall;

(ii) an access port in at least one opposing pawl cavity wall;

(iii) a pin aperture through each opposing pawl cavity wall;

(b) a pawl cavity retained within the pawl cavity of the C-clamp, said pawl having a plurality of pawl ratchet teeth thereon;

(c) a split pin having a rear half and a forward half attached by at least one shearable connection means, a face of the rear half having a plurality of ratchet teeth thereon, said split pin providing a wedge fit between the C-clamp and the lip;

(d) a biasing means between said rear pawl cavity wall and said pawl to bias the pawl against the ratchet surface of the rear split pin; and (e) a pin slidably engaged in the pin aperture, said pin constraining said pawl within said pawl cavity.

10. The retaining mechanism of claim 9 wherein said pawl is positionable within said pawl cavity between an engaged and a disengaged position.

11. The retaining mechanism of claim 9 wherein said biasing means comprises a resilient rubber spring.

12. The retaining mechanism of claim 9 wherein shearable connection means comprises at least one shear screw.

13. The retaining mechanism of claim 9 wherein shearable connection means comprises an elastomeric element bonded between the forward and rear split pin halves.

14. The retaining mechanism of claim 9 wherein said pawl is split into a first pawl section and a second pawl section, each of said pawl sections having a ratchet surface, said ratchet surface of one pawl section offset from that of the other pawl section.

15. A retaining mechanism for captively retaining an adapter interengaged to the forward lip of an excavating bucket, said adapter and lip having aligned transverse openings therethrough, said retaining mechanism comprising:

(a) a C-clamp with a first and second face, said first face engaged to a forward wall of the adapter, said second face having a pawl cavity therein;

(b) a pawl cavity retained within the pawl cavity of the C-clamp, said pawl having a plurality of pawl ratchet teeth thereon;

(c) a split pin having a rear half and a forward half attached by shear screws, a face of the rear half having a plurality of ratchet teeth thereon, said split pin providing a wedge fit between the C-clamp and the lip; and (d) a biasing means between said C-clamp and said pawl to bias the pawl against the split pin.

16. A retaining mechanism for captively retaining an adapter interengaged to the forward lip of an excavating bucket, said adapter and lip having aligned transverse openings therethrough, said retaining mechanism comprising:

(a) a C-clamp with a first and second face, said first face engaged to a forward wall of the adapter, said second face having a pawl cavity therein;

(b) a pawl cavity retained within the pawl cavity of the C-clamp; wherein said pawl is split into a first pawl section and a second pawl section, each of said pawl sections having a ratchet surface, said ratchet surface of one pawl section offset from that of the other pawl section;

(c) a split pin, said split pin having a rear half and a forward half, a face of the rear half having a plurality of ratchet teeth thereon, said split pin providing a wedge fit between the C-clamp and the lip; and (d) a biasing means between said C-clamp and said pawl, said biasing means positioned to bias the pawl against the split pin.

17. A retaining mechanism for captively retaining an adapter interengaged to the forward lip of an excavating bucket, said adapter and lip having aligned transverse openings therethrough, said retaining mechanism comprising:

(a) a C-clamp with a first and second face, said first face engaged to a forward wall of the adapter, said second face having a pawl cavity therein, said pawl cavity comprises (i) opposing pawl cavity walls and (ii) a rear pawl cavity wall;

(ii) an access port in at least one opposing pawl cavity wall;

(iii) a pin aperture through each opposing pawl cavity wall;

(b) a pawl cavity retained within the pawl cavity of the C-clamp, said pawl having a plurality of pawl ratchet teeth thereon;

(c) a split pin having a rear half and a forward half attached by at least one shear screw, a face of the rear half having a plurality of ratchet teeth thereon, said split pin providing a wedge fit between the C-clamp and the lip;

(d) a biasing means between said rear pawl cavity wall and said pawl to bias the pawl against the ratchet surface of the rear split pin; and (e) a pin slidably engaged in the pin aperture, said pin constraining said pawl within said pawl cavity.

18. A retaining mechanism for captively retaining an adapter interengaged to the forward lip of an excavating bucket, said adapter and lip having aligned transverse openings therethrough, said retaining mechanism comprising:

(a) a C-clamp with a first and second face, said first face engaged to a forward wall of the adapter, said second face having a pawl cavity therein, said pawl cavity comprises (i) opposing pawl cavity walls and (ii) a rear pawl cavity wall;

(ii) an access port in at least one opposing pawl cavity wall;

(iii) a pin aperture through each opposing pawl cavity wall;

(b) a pawl cavity retained within the pawl cavity of the C-clamp, said pawl having a plurality of pawl ratchet teeth thereon and wherein said pawl is split into a first pawl section and a second pawl section, each of said pawl sections having a ratchet surface, said ratchet surface of one pawl section offset from that of the other pawl section;

(c) a split pin having a rear half and a forward half attached by at least one shearable connection means, a face of the rear half having a plurality of ratchet teeth thereon, said split pin providing a wedge fit between the C-clamp and the lip;

(d) a biasing means between said rear pawl cavity wall and said pawl to bias the pawl against the ratchet surface of the rear split pin; and (e) a pin slidably engaged in the pin aperture, said pin constraining said pawl within said pawl cavity.

19. A method of captively retaining an adapter interengaged to the forward lip of an excavating bucket, said adapter and lip having aligned transverse openings therethrough, said method comprising:

(a) seating a C-clamp against an adapter face defining the opening in said adapter, said C-clamp providing a pawl cavity therein;

(b) placing a pawl within the pawl cavity, said pawl having a ratchet surface;

(c) wedging a split pin into said opening adjacent to said C-clamp, said split pin having a forward half in sliding engagement with the lip and a rear half with a ratchet surface;

(d) engaging the ratchet surface of said rear split pin half with the pawl ratchet surface;

(e) disengaging said pawl ratchet surface from said wedge ratchet surface by manipulating said pawl through an access port; and (f) removing said split pin assembly upward through said opening.

20. A method of captively retaining an adapter interengaged to the forward lip of an excavating bucket, said adapter and lip having aligned transverse openings therethrough, said method comprising:

(a) seating a C-clamp against an adapter face defining the opening in said adapter, said C-clamp providing a pawl cavity therein;

(b) placing a pawl within the pawl cavity, said pawl having an offset ratchet surface;

(c) wedging a split pin into said opening adjacent to said C-clamp, said split pin having a forward half in sliding engagement with the lip and a rear half with a ratchet surface;

(d) engaging the ratchet surface of said rear split pin half with the pawl offset ratchet surface; and (e) driving said forward split pin downward through said opening.

* * * * *